United States Patent [19]

Murdock

[11] Patent Number: 4,852,800

[45] Date of Patent: Aug. 1, 1989

[54] METHOD AND APPARATUS FOR STABILIZING FLOW TO SHARP EDGED ORIFICES

[75] Inventor: G. Duncan Murdock, Kent, Wash.

[73] Assignee: Flow Systems, Inc., Kent, Wash.

[21] Appl. No.: 744,980

[22] Filed: Jun. 17, 1985

[51] Int. Cl.[4] ..... B05B 1/00; E21B 7/18

[52] U.S. Cl. ..... 239/1; 239/596

[58] Field of Search ..... 239/1, 589, 596, 594, 239/601, 590, 591; 299/17; 175/424; 51/439

[56] References Cited

U.S. PATENT DOCUMENTS

| | | | |
|---|---|---|---|
| 2,258,001 | 10/1941 | Chamberlain | 255/1 |
| 3,386,521 | 6/1968 | Chadderdon et al. | 175/269 |
| 3,419,220 | 12/1968 | Goodwin et al. | 239/591 |
| 3,469,642 | 9/1969 | Goodwin et al. | 175/393 |
| 3,688,853 | 9/1972 | Maurer et al. | 175/422 |
| 3,756,106 | 9/1973 | Chadwick et al. | 83/177 |
| 3,924,805 | 12/1975 | Nebeker et al. | 239/1 |
| 3,960,407 | 6/1976 | Noren | 299/17 |
| 3,997,111 | 12/1976 | Thomas et al. | 239/596 |
| 4,047,580 | 9/1977 | Yahiro et al. | 175/67 |
| 4,131,236 | 12/1978 | Saunders | 239/589 |
| 4,150,794 | 4/1979 | Higgins | 239/596 |
| 4,221,271 | 9/1980 | Barker | 175/422 |
| 4,244,521 | 1/1981 | Guse | 175/424 X |
| 4,313,570 | 2/1982 | Olsen | 239/583 |
| 4,369,850 | 1/1983 | Barker | 175/393 |
| 4,392,534 | 7/1983 | Miida | 175/340 |

*Primary Examiner*—Andres Kashnikow
*Assistant Examiner*—Kevin P. Weldon
*Attorney, Agent, or Firm*—Ashen, Golant, Martin & Seldon

[57] ABSTRACT

A method and apparatus for stablizing flow to sharp edged orifices by placing a convergent section upstream of the orifice.

7 Claims, 1 Drawing Sheet

METHOD AND APPARATUS FOR STABLIZING FLOW TO SHARP EDGED ORIFICES

FIELD OF INVENTION

This invention pertains to fluid flows particularly to liquid flows to a sharp edged orifice more particularly to reduced turbulence in liquid flow to and from a liquid jet cutting orifice.

BACKGROUND OF INVENTION

Liquid jet cutting devices are in common use for cutting a wide variety of materials. Such a device usually consists of a source of high pressure fluid such as a hydraulic intensifier, a conduit system and an orifice. The orifice is often a jewel such as synthetic sapphire pierced by a hole which creates the sharp edged orifice. Mountings for the jewel are often quite complex as they must withstand both high pressure and rapidly changing pressure.

A major design problem with waterjet cutting apparatus is the presence of turbulence upstream of the orifice. If turbulence is present upstream of the orifice, the result is turbulence in the cutting jet which increases the size of the kerf, reduces the cutting ability, and may also result in undesirable wetting of the substance being cut. The most successful means of preventing turbulence to data is the addition of a collimating chamber upstream of the orifice. This type of device is described in U.S. Pat. No. 3,997,111. A disadvantage of such a chamber is the additional length and weight of the cutting assembly. Accordingly, a demand exists for a lightweight simple means of collimating fluid flow upstream of an orifice.

SUMMARY OF INVENTION

The invention provides a stable coherent flow of fluid to and from a jet cutting orifice. The device is simple, lightweight and smaller than existing design.

A converging section is placed in the collimating chamber upstream of the nozzle. This provision allows the collimating chamber to be shorter than straight ended chambers.

Figure 1:
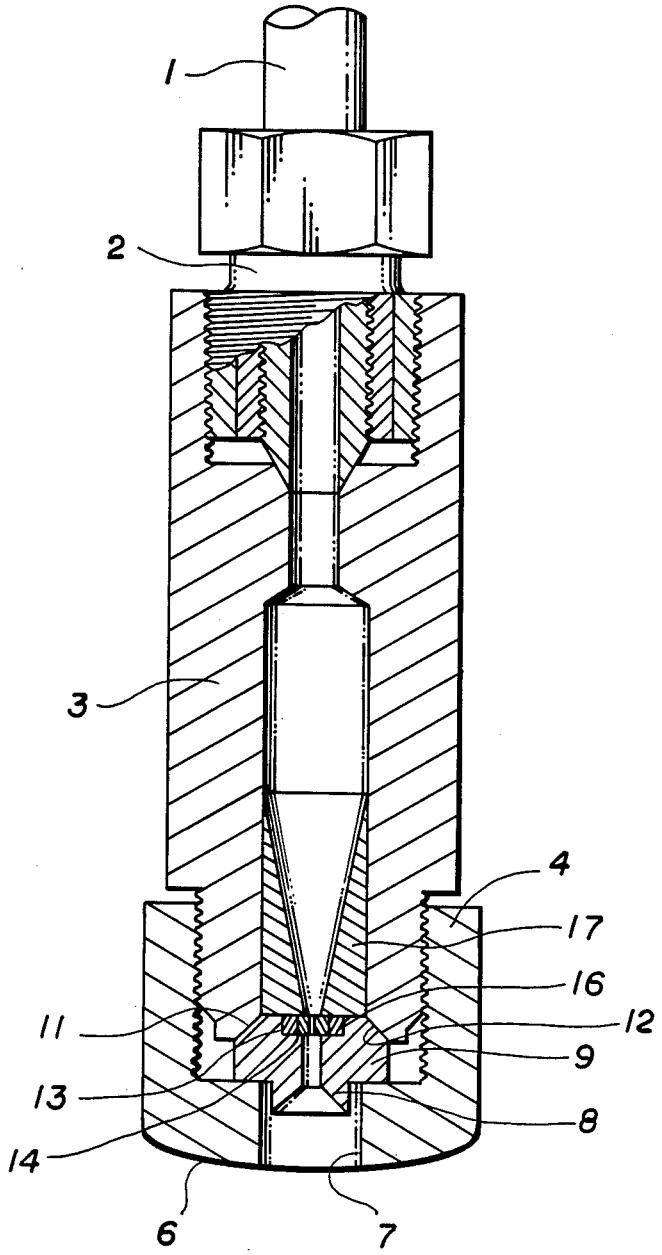
FIG. 1 is a section elevation view of the invention.

DETAILED DESCRIPTION OF THE FIGURES:

FIG. 1 is a section elevation view of the invention. High pressure fluid is supplied by conduit 1. Conduit 1 terminates in a Connector 2 which is a conventional high pressure fitting. Connector 2 is connected to a collimating chamber 3. Collimating chamber 3 is an elongate cylindrical chamber having sufficient wall thickness to contain the high pressure fluid which is typically in the range of 10,000 to 100,000 p.s.i. The end of chamber 3 opposite to that, connected to connector 2, is provided with a threaded section 4. Threaded section 4 accepts a foreward cap 6. Foreward cap 6 is provided with a passage 7. Passage 7 accepts the stem 8 of a jewel holder 9. Different types of jewel holders exist, some with the stem 8 and some without. Also, sealing surface angle can change radically from the one shown. Jewel holder 9 includes a seat 11 to seal to a similar surface 12 on collimating chamber 3. Jewel holder 9 is also provided with a recess 13. Recess 13 in turn, accepts a jewel orifice 14 surrounded by a retention member 16. To this point the invention is substantially similar to that described in U.S. Pat. No. 3,997,111 except for the length of collimating chamber 3. The difference lies in the addition of a collimating cone 17 adjacent to jewel orifice 14.

In operation, cone 17 stabilizes flow and eliminates turbulence incurred in the square ended chamber. In addition, variations in the stream exiting the nozzle is reduced, producing a laminar, more coherent stream. The addition of cone 17 increases the coherent length of the fluid jet emerging from orifice 14 from 10 to 250%.

It has been found, for example, that if cône 17 is 0.75 inches in length in a one inch long collimating chamber, the cone having a top internal diameter of 0.265 inches and an exit diameter of 0.085 inches, a jewel orifice with a 0.005 inch orifice will produce a cutting jet having the same characteristics as the same jewel in a 3 inch collimating chamber without a cone. A step between the exit of the cone 17 and the jewel orifice 14 is necessary to produce a sharp-edged orifice effect needed for proper cutting.

In tests of a nozzle without a collimating cone, a given nozzle would not produce an acceptable cut of printed circuit board material. When the cone was added, the cut was acceptable. Similarly, the cone allowed an acceptable cut on 90 pound paper at a rate of 2800 ft./min. when no acceptable cut could be made without the chamber.

The above discussion is explanatory only, the invention being defined by the claims only.

I claim:

1. An improved fluid jet cutting nozzle of the type utilizing a jeweled orifice downstream of a collimating chamber, the improvement comprising:

a convergent cone upstream of the jeweled orifice adjacent thereto for collimating the fluid flow to said orifice, the minimum diameter of the cone being larger than the diameter of the orifice; and, means for mounting said convergent cone in said collimating chamber.

2. A nozzle as in claim 1 wherein the diameter of the downstream end of said convergent cone is larger than the diameter of the jewel orifice.

3. A nozzle as in claim 2 wherein the length of said cone is at least ½ of the length of said collimating chamber.

4. A method for controlling turbulence upstream of a jewel cutting orifice in a fluid jet cutting tool comprising the steps of:

producing a stream of high pressure fluid;

passing said stream through a convergent cone section to remove turbulence; and, passing said converged stream through a jewel orifice adjacent the convergent cone section which has a diameter less than the minimum diameter of the convergent cone section to produce a coherent fluid cutting jet.

5. A method as in claim 4 further comprising the step of forcing said converged stream to pass a sharp step.

6. A method for increasing the coherent length of a fluid jet emerging from the jewel orifice of a fluid jet cutting tool, comprising the steps of:

producing a stream of high pressure fluid; and, passing said stream through a convergent cone section adjacent the orifice, the minimum diameter of the convergent cone section being greater than the diameter of said orifice.

7. An improved fluid jet cutting nozzle of the type utilizing a jeweled orifice downstream of a collimating chamber, the improvement comprising:

a convergent cone upstream of the jewel orifice for collimating the fluid flow to said orifice, the minimum diameter of the downstream end of the convergent cone being larger than the diameter of the orifice, the length of said cone being at least ½ of the length of said collimating chamber; and means for mounting said convergent cone in said collimating chamber.

* * * * *